US006443961B1

(12) United States Patent
Waldner et al.

(10) Patent No.: US 6,443,961 B1
(45) Date of Patent: Sep. 3, 2002

(54) DEPILATION DEVICE WITH A HOUSING OF ANGLED DESIGN

(75) Inventors: Roland Waldner, Pubersdorf; Christian Schumi, Villach, both of (AT); Natassia Jacobs, Rotterdam (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 95 days.

(21) Appl. No.: 09/590,848

(22) Filed: Jun. 9, 2000

(30) Foreign Application Priority Data

Jun. 11, 1999 (EP) ..... 99890186

(51) Int. Cl.[7] ..... A61B 17/50
(52) U.S. Cl. ..... 606/133
(58) Field of Search ..... 606/133, 131, 606/1, 186, 187

(56) References Cited

U.S. PATENT DOCUMENTS 4,726,375 A * 2/1988 Gross et al. ..... 606/133
4,899,748 A * 2/1990 Gross ..... 606/133

FOREIGN PATENT DOCUMENTS

| | | | |
|---|---|---|---|
| DE | 29611519 | 10/1996 | |
| EP | 0348862 A2 | 1/1990 | ..... A45D/26/00 |
| EP | 0381876 A2 | 8/1990 | ..... A45D/26/00 |
| EP | 0532106 B1 | 3/1993 | ..... A45D/26/00 |
| EP | 05321078 B1 | 3/1993 | ..... A45D/26/00 |
| EP | 0622033 A2 | 11/1994 | |

* cited by examiner

*Primary Examiner*—Kevin T. Truong
(74) *Attorney, Agent, or Firm*—Ernestine C. Bartlett

(57) ABSTRACT

A depilation device is provided with a housing which has a handle portion extending parallel to a longitudinal housing direction, which handle portion can be held in one hand, and a head portion connected to the handle portion, and with depilation means which are provided in the region of the head portion and which can be applied to a body region to be depilated transversely to the longitudinal housing direction, wherein, the housing being of angled design, so that the head portion extends transversely to the handle portion, while the depilation means are formed by depilation discs which are provided at the free end of the head portion facing away from the handle portion.

3 Claims, 1 Drawing Sheet

DEPILATION DEVICE WITH A HOUSING OF ANGLED DESIGN

The invention relates to a depilation device as defined in the preamble of claim 1.

Such a depilation device as defined in the preamble of claim 1 is known, for example, from patent document EP 0 348 862 A2. The known depilation device comprises a housing which extends substantially fully in one longitudinal housing direction, so that the handle portion and the head portion extend in the longitudinal housing direction, while the depilation means formed by a drivable spiraling spring are present at a side wall of the housing which extends substantially parallel to the longitudinal housing direction. This design of the housing and this arrangement of the depilation means relative to the housing result in a comparatively uncomfortable handling of the known depilation device in various operational situations during operation, in particular when a depilation operation is to be carried out in the region of a body cavity or an inner curve of the body. It was found with the known depilation device, furthermore, that the depilation means thereof are comparatively badly visible during operation of the device, so that a directional application of the depilation means to hairs to be removed can be carried out with insufficient accuracy, which renders a fast and satisfactory depilation operation more difficult.

The invention has for its object to avoid the problems described above, or at least to reduce them to such an extent that no adverse influences occur as in the known depilation device, and to provide an improved depilation device.

To achieve the above object, the characteristics as defined in the characterizing part of claim 1 are provided in a depilation device as defined in the preamble of claim 1. The provision of the features according to the invention safeguards a very comfortable handling of the depilation device in a simple manner and practically without additional means at all times, also when a depilation operation is to be carried out in body cavities or inner curves of the body. It is furthermore achieved by means of the characteristic features of the invention that the depilation discs provided in the region of the free end of the head portion are readily visible during a depilation operation, so that the depilation discs can be accurately aimed at hairs to be removed, which safeguards a fast and effective depilation operation.

It may be noted that a depilation device is known, for example, from the two patent documents EP 0 532 106 B1 and EP 0 532 107 B1 which can be held in one hand during operation and which comprises depilation discs as the depilation means which can be driven into rotation, and which has a housing with a handle portion and a head portion; however, the entire housing extends in the longitudinal housing direction here, and accordingly both the handle portion and the head portion extend parallel to the longitudinal housing direction, while the depilation discs are provided in the region of the free end of the head portion. It is true that in either of these depilation devices the depilation discs are well visible during a depilation operation, but holding of the depilation device is not so pleasant on account of the longitudinal housing design, so that a longer depilation activity may lead to undesirable fatigue symptoms in the hand holding the depilation device, and a comfortable handling of the depilation device is not always safeguarded in the case of a longer depilation operation.

It may further be noted that a depilation device is known from the patent document EP 0 381 876 A2 which comprises as its depilation means depilation rollers which can be driven into rotation and which are provided in the region of an opening of the housing of the depilation device. The housing of the depilation device is here directed substantially parallel to a longitudinal housing direction which is perpendicular to the axes of the depilation rollers, and this housing comprises a head portion containing the depilation rollers and a handle portion merging into said head portion in the longitudinal housing direction and formed in part by a housing cover. The housing of this depilation device comprises a lateral curvature in the region of its handle portion, which curvature is provided for accommodating a drive motor for driving the depilation rollers, but which does not form a separate handle portion of the housing. No particularly comfortable handling was achieved in this known depilation device either, the cause thereof being the longitudinal housing design which extends substantially parallel to the longitudinal housing direction. It may be noted that the elongate housing of the depilation device was realized without lateral curvature by means of a modified arrangement of the drive motor as compared with the solution disclosed in the patent document EP 0 381 876 A2, which patent document relates to a depilation device actually marketed by applicant. The above-mentioned midified depilation device was brought on the market by applicant under the type designation HP 2830.

In a depilation device according to the invention, the transition between the handle portion and the head portion may be an abrupt one. It was found to be very advantageous, however, when in addition the characteristic as claimed in claim 2 is provided in a depilation device according to the invention. Such an arrangement of the depilation device according to the invention can be held and handled in a particularly comfortable manner.

It was furthermore found to be highly advantageous in a depilation device according to the invention when in addition the characteristics as claimed in claim 3 are provided. Such an arrangement was found to be favorable with regard to a pleasant and comfortable actuation of the switching means.

The aspects described above and further aspects of the invention will become apparent from the following description of an embodiment and are clarified further with reference to this embodiment.

The invention will be described in more detail below with reference to an embodiment shown in the drawings to which, however, the invention is not limited.

Figure 1:
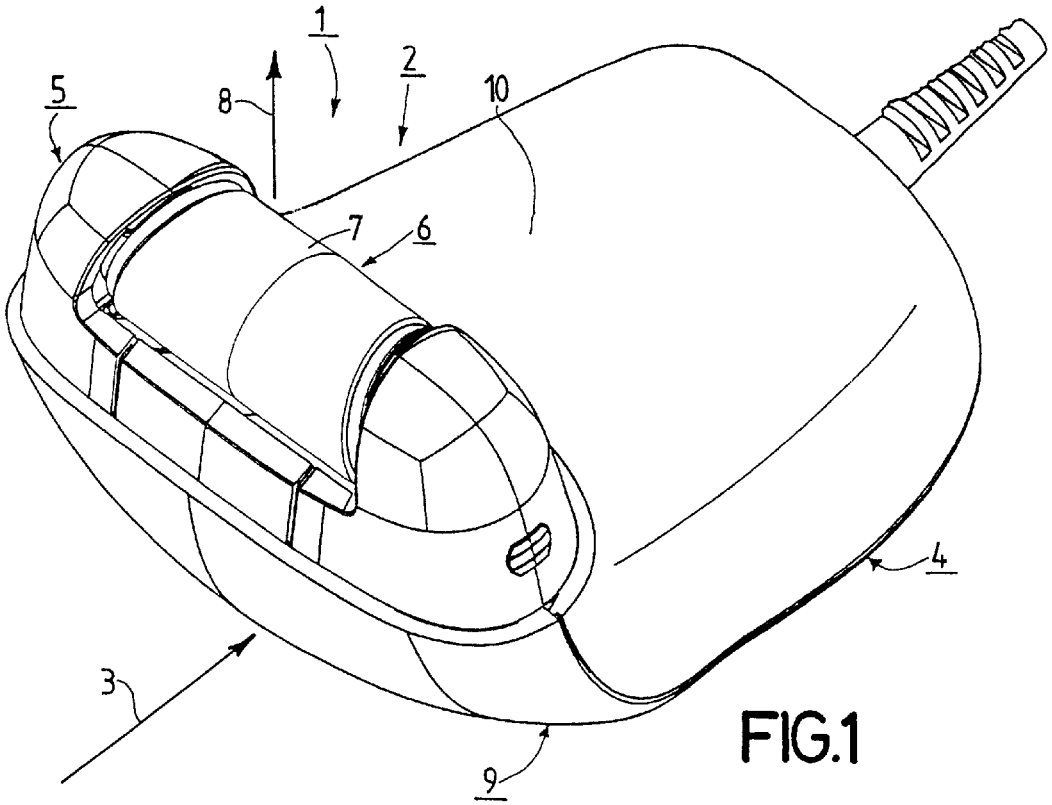
FIG. 1 is an oblique elevation viewed from below of a depilation device according to the invention in a first embodiment of the invention.
Figure 2:
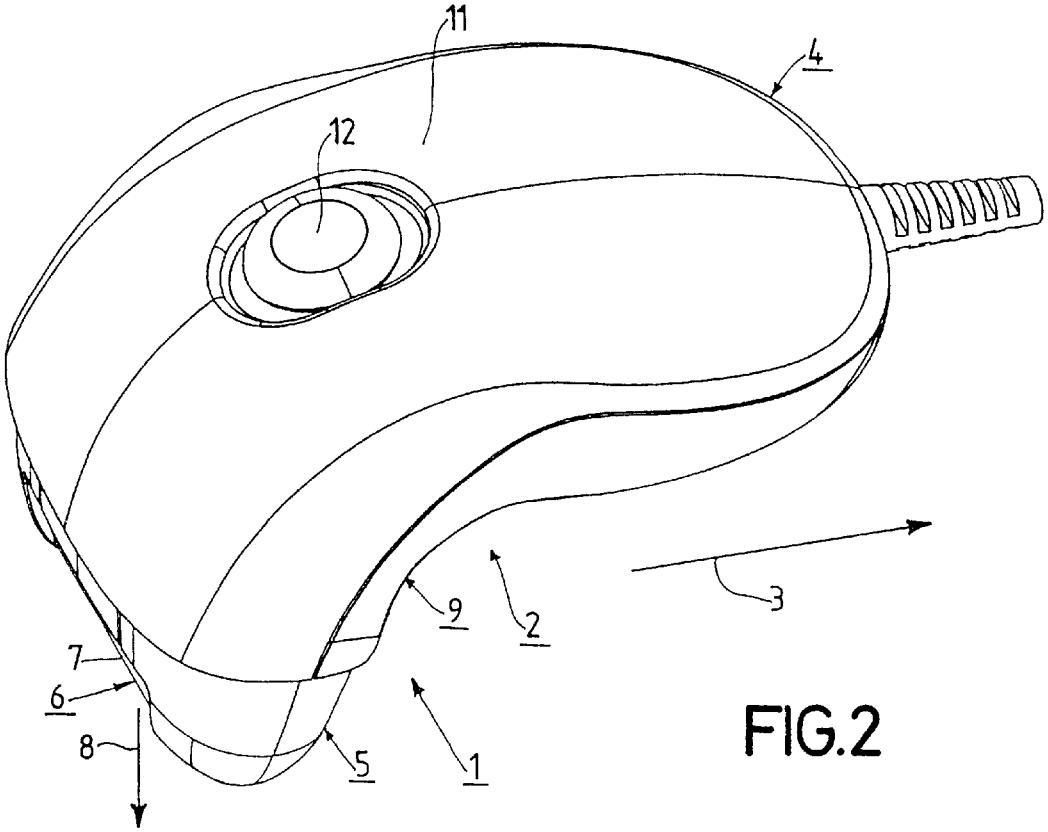
FIG. 2 shows the depilation device of FIG. 1 in an oblique elevation viewed from above.

FIGS. 1 and 2 show a depilation device 1 which can be held in one hand during operation. The depilation device 1 comprises a housing 2, a longitudinal housing direction of which can be defined as indicated by an arrow 3. The housing 2 comprises a handle portion 4 which extends substantially parallel to the longitudinal housing direction 3 and which is provided and designed for being held in one hand during the operation of the depilation device 1. The housing 2 further comprises a head portion 5 connected to the handle portion 4. The depilation device 1 is provided with depilation means 6 in the region of the head portion 5, said means being constructed for removing hairs. The depilation means 6 are not shown in any detail in the depilation device 1. The depilation means are formed in a known manner by depilation discs which can be driven into rotation and which are arranged next to one another with respect to their axes of rotation, thus forming a so-called depilation cylinder 7 which is depicted in FIGS. 1 and 2. Reference may be made to the two patent documents EP 0 532 106 B1 and EP 0 532 107 B1, whose disclosures are deemed to be included in the present application through reference to said patent documents, as regards such depilation means 6 formed by depilation discs.

The depilation means 6, i.e. the depilation discs, are arranged in the depilation device 1 in the region of the head portion 5 of the housing 2 such that they can be laid on a skin region to be depilated in an application direction which is perpendicular to the longitudinal housing direction 3. The application direction is indicated with an arrow 8 in FIGS. 1 and 2.

The constructional shape of the depilation device 1 is advantageously chosen such that the housing 2 has an angled design, and that thus the head portion 5 extends substantially transverse to the handle portion 4, and accordingly to the longitudinal housing direction 3. In the present case, the handle portion 4 and the head portion 5 are practically perpendicular to one another, but this need not necessarily be the case. Advantageously, furthermore, the depilation means 6 are provided at the free end of the head portion 5 which is remote from the handle portion 4. As is clearly visible in FIGS. 1 and 2, the handle portion 4 and the head portion 5 of the depilation device 1 are joined together by means of a curved transitional portion 9, which is also very advantageous.

On account of its angled design, the curved housing has a front outer wall 10 and a read outer wall 11. A switching means 12 is provided here in the region of the rear outer wall 11, formed by a sliding switch and designed for switching at least one operational state of the depilation device 1, in the present case for switching the ON-state of the depilation device 1 and for switching the OFF-state of the depilation device 1.

The design of the depilation device 1 as described above safeguards a very comfortable handling of this depilation device 1, also when a depilation operation is carried out in the region of body cavities or in the region of inner curves of the body, because the curved or angled design of the depilation device 1 causes the depilation means 6, i.e. the depilation discs, to project comparatively far in lateral direction from the handle portion 4 of the depilation device 1, which can be comfortably held in one hand, with the result that skin portions in the regions of body cavities and in the regions of inner curves of the body can be easily reached, while at the same time a comfortable handling of the depilation device is safeguarded. A further advantage of the depilation device 1 lies in the fact that the depilation discs arranged in the region of the free end of the head portion 5 are clearly visible during a depilation operation, while the depilation device is being comfortably held, so that the depilation discs can be accurately directed at hairs to be removed, which safeguards a fast and effective depilation operation accompanied by a comfortable handling.

What is claimed is:

1. A depilation device (1), which can be held in one hand during operation of said device, and which comprises a housing (2) comprising a handle portion (4) extending substantially parallel to a longitudinal housing direction (3) of said housing (2), and a head portion (5) connected to said handle portion (4), and which head portion (5) is provided with depilation means (6) and which depilation means (6) are arranged such that they can be applied to a skin region to be depilated in an application direction (8) which is transverse to the longitudinal housing direction (3), wherein:

the housing (2) is angled so that the head portion (5) is substantially transverse to the handle portion (4) and thus to the longitudinal housing direction (3), and the depilation means (6) are formed by rotatable depilation discs and which depilation discs are provided at a free end of the head portion (5) facing away from the handle portion (4).

2. A depilation device (1) as claimed in claim 1, wherein the handle portion (4) and the head portion (5) are connected to one another by means of a curved transitional portion (9).

3. A depilation device (1) as claimed in claim 1, wherein the angled housing (2) has a front outer wall (10) and a rear outer wall (11), and in that a switching means (12) for switching at least one operational state of the depilation device (1) is provided on the rear outer wall (11).

* * * * *